US010037730B2

(12) United States Patent
Zhou et al.

(10) Patent No.: US 10,037,730 B2
(45) Date of Patent: Jul. 31, 2018

(54) PIXEL CIRCUIT, DRIVE METHOD, ARRAY SUBSTRATE, DISPLAY PANEL AND DISPLAY DEVICE

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventors: Maoxiu Zhou, Beijing (CN); Peng Jiang, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 15/554,516

(22) PCT Filed: Jan. 18, 2017

(86) PCT No.: PCT/CN2017/071519

§ 371 (c)(1),
(2) Date: Aug. 30, 2017

(87) PCT Pub. No.: WO2017/193630

PCT Pub. Date: Nov. 16, 2017

(65) Prior Publication Data

US 2018/0166008 A1 Jun. 14, 2018

(30) Foreign Application Priority Data

May 11, 2016 (CN) ..... 2016 1 0305849

(51) Int. Cl.
*G09G 5/00* (2006.01)
*G09G 3/3225* (2016.01)

(52) U.S. Cl.
CPC ... *G09G 3/3225* (2013.01); *G09G 2310/0251* (2013.01); *G09G 2320/045* (2013.01)

(58) Field of Classification Search
None
See application file for complete search history.

(56) References Cited

U.S. PATENT DOCUMENTS 6,525,704 B1 * 2/2003 Kondo ..... G09G 3/3233 315/169.3
8,044,895 B2 * 10/2011 Miyake ..... G09G 3/3233 315/169.3

(Continued)

FOREIGN PATENT DOCUMENTS

CN 101859791 A 10/2010
CN 101996579 A 3/2011

(Continued)

OTHER PUBLICATIONS

PCT (CN) International Search Report, Application No. PCT/CN2017/071519, dated Apr. 18, 2017, 5 pgs.

(Continued)

*Primary Examiner* — Christopher R Lamb
(74) *Attorney, Agent, or Firm* — Armstrong Teasdale LLP

(57) ABSTRACT

A pixel circuit is disclosed, which includes a charging module, a storage module, an adjusting module, a data-in module, a drive module, and a light-emitting device. A first end of the charging module is configured to receive a first voltage signal, a second end of the charging module is coupled to a first end of the light-emitting device, and a third end of the charging module is coupled to a first end of the memory module, a second end of the light-emitting device and a first end of the drive module. A second end of the storage module is coupled to a first end of the adjusting module. A second end of the adjusting module is coupled to (Continued)

a second end of the data-in module and a third end of the drive module. A first end of the data-in module is configured to receive a data signal.

20 Claims, 5 Drawing Sheets

(56) References Cited

U.S. PATENT DOCUMENTS

| | | | | |
|---|---|---|---|---|
| 2007/0139311 | A1* | 6/2007 | Cho | G09G 3/3241 345/76 |
| 2012/0120042 | A1 | 5/2012 | Tsai et al. | |
| 2014/0070725 | A1* | 3/2014 | Qi | G09G 3/3233 315/291 |
| 2016/0055792 | A1 | 2/2016 | Lee et al. | |
| 2016/0189604 | A1* | 6/2016 | Hu | G09G 3/3225 345/215 |

FOREIGN PATENT DOCUMENTS

| | | | |
|---|---|---|---|
| CN | 104021763 | A | 9/2014 |
| CN | 104485074 | A | 4/2015 |
| CN | 105761676 | A | 7/2016 |

OTHER PUBLICATIONS

PCT (CN) Written Opinion, Application No. PCT/CN2017/071519, dated Apr. 18, 2017, 12 pgs.: with English translation.

* cited by examiner

PIXEL CIRCUIT, DRIVE METHOD, ARRAY SUBSTRATE, DISPLAY PANEL AND DISPLAY DEVICE

CROSS REFERENCE TO RELATED APPLICATIONS

This patent application is a National Stage Entry of PCT/CN2017/071519 filed on Jan. 18, 2017, which claims the benefit and priority of Chinese Patent Application No. 201610305849.9 filed on May 11, 2016, the disclosures of which are incorporated herein by reference in their entirety as part of the present application.

BACKGROUND

Exemplary embodiments of the present disclosure relate to the field of display technologies, and more particularly to a pixel circuit and a drive method thereof, and a corresponding array substrate, a display panel, and a display device.

An organic light-emitting diode (OLED), as a current driven light-emitting device, has been widely applied in high-performance display devices. As a size of a display panel is increased, a traditional passive matrix organic light-emitting diode (PMOLED) needs shorter drive time for a single pixel, and thus larger transient current of it is caused, such that power consumption of it is increased. However, an active matrix organic light-emitting diode (AMOLED) can solve the above problems by inputting current for OLEDs in a row-by-row scanning method with switching transistors.

Drift in a threshold voltage (Vth) of a thin-film transistor (TFT) used in the AMOLED may be caused due to process variations or long time operation, which may cause currents of different pixels to be uneven, thus affect the color of a display image.

BRIEF DESCRIPTION

Exemplary embodiments of the present disclosure provide a pixel circuit and a drive method thereof, and a corresponding array substrate, a display panel, and a display device, which can eliminate current fluctuation caused by drift of the threshold voltage Vth, thereby maintaining a quality of the display image.

A first aspect of the present disclosure provides a pixel circuit, which includes a charging module, a storage module, an adjusting module, a data-in module, a drive module, and a light-emitting device. A first end of the charging module is configured to receive a first voltage signal, a second end of the charging module is coupled to a first end of the light-emitting device, and a third end of the charging module is coupled to a first end of the storage module, a second end of the light-emitting device and a first end of the drive module. A second end of the storage module is coupled to a first end of the adjusting module. A second end of the adjusting module is coupled to a second end of the data-in module and a third end of the drive module. A first end of the data-in module is configured to receive a data signal. A second end of the drive module is configured to receive a second voltage signal. The charging module is configured to charge the storage module. The adjusting module is configured to compensation for a voltage of the drive module. The drive module is configured to drive the light-emitting device to emit light.

According to an embodiment of the present disclosure, the charging module includes a first transistor and a third transistor. A first electrode of the first transistor is configured to receive the first voltage signal, a control electrode of the first transistor is configured to receive a first control signal, and a second electrode of the first transistor is coupled to a first electrode of the third transistor and the first end of the light-emitting device. A control electrode of the third transistor is configured to receive a second control signal. A second electrode of the third transistor is coupled to the first end of the storage module, the second end of the light-emitting device and the first end of the drive module.

According to an embodiment of the present disclosure, the storage module includes a capacitor. A first end of the capacitor is coupled to the first end of the drive module, the second end of the light-emitting device and the third end of the charging module. A second end of the capacitor is coupled to the first end of the adjusting module.

According to an embodiment of the present disclosure, the adjusting module includes a second transistor. A first electrode of the second transistor is coupled to the second end of the capacitor. A second electrode of the second transistor is coupled to the second end of the data-in module and the third end of the drive module. A control electrode of the second transistor is configured to receive the first control signal.

According to an embodiment of the present disclosure, the drive module includes a drive transistor. A first electrode of the drive transistor is coupled to the first end of the capacitor, the second end of the light-emitting device and the third end of the charging module. A second electrode of the drive transistor is configured to receive the second voltage signal. A control electrode of the drive transistor is coupled to the second electrode of the second transistor and the second end of the data-in module.

According to an embodiment of the present disclosure, the data-in module includes a fourth transistor. A first electrode of the fourth transistor is configured to receive the data signal. A second electrode of the fourth transistor is coupled to the control electrode of the drive transistor and the second electrode of the second transistor. A control electrode of the fourth transistor is configured to receive a scanning signal.

According to an embodiment of the present disclosure, the transistors in the pixel circuit are N-type transistors.

According to an embodiment of the present disclosure, the transistors in the pixel circuit are P-type transistors.

A second aspect of the present disclosure provides a pixel circuit group, which includes a plurality of pixel circuits as mentioned above, in which the data-in modules of the plurality of pixel circuits are coupled to the same data line.

A third aspect of the present disclosure provides a drive method for driving any one of the above pixel circuits, which includes in a charging phase, charging the storage module such that a voltage at the first end of the storage module is a first voltage, in a voltage adjusting phase, adjusting the voltage of the drive module such that the voltage at the first end of the storage module is a sum of the data voltage and a threshold voltage of the drive transistor in the drive module, in a light emitting phase, keeping the light-emitting device emitting light and causing a voltage at the third end of the drive module to equal the first voltage minus the sum of the data voltage and the threshold voltage of the drive transistor in the drive module.

A fourth aspect of the present disclosure provides a drive method for driving the above pixel circuit group, which includes in a charging phase, charging the storage modules of the plurality of pixel circuits such that a voltage at the first end of the storage module of each pixel circuit is a first voltage, in a voltage adjusting phase, adjusting the voltage of the drive modules of the plurality of pixel circuits in sequence such that the voltage at the first end of the storage module of each pixel circuit is a sum of the data voltage of the corresponding pixel circuit and a threshold voltage of the drive transistor in the drive module of the corresponding pixel circuit, in a light emitting phase, keeping the light-emitting device emitting light and causing a voltage at the third end of the drive module of each pixel circuit to equal the first voltage minus the sum of the data voltage of the corresponding pixel circuit and the threshold voltage of the drive transistor in the drive module of the corresponding pixel circuit.

A fifth aspect of the present disclosure provides an array substrate, which includes any one of the aforementioned pixel circuits.

A sixth aspect of the present disclosure provides an array substrate, which includes the aforementioned pixel circuit group.

A seventh aspect of the present disclosure provides a display panel, which includes any one of the aforementioned array substrates.

An eighth aspect of the present disclosure provides a display device, which includes any one of the aforementioned display panels.

BRIEF DESCRIPTION OF THE DRAWINGS

In order to describe the technical solutions of the embodiments of the present disclosure or more clearly, the accompanying drawings for describing the embodiments will be briefly introduced below. Apparently, the accompanying drawings in the following description are merely some embodiments of the present disclosure. To those of ordinary skills in the art, other accompanying drawings may also be derived from these accompanying drawings without creative efforts.

DETAILED DESCRIPTION

To make the technical solutions and advantages of the embodiments of the present disclosure clearer, technical solutions in embodiments of the present disclosure will be described clearly and completely below, in conjunction with the accompanying drawings in the embodiments of the present disclosure. Obviously, the described embodiments are merely some but not all of the embodiments of the present disclosure. All other embodiments obtained by those of ordinary skills in the art based on the embodiments of the present disclosure without creative efforts shall fall within the protection scope of the present disclosure.

In all the embodiments of the present disclosure, a source and a drain (an emitter and a collector) of a transistor are symmetrical, and a current from the source to the drain (from the emitter to the collector) to turn on an N-type transistor is in an opposite direction with respect to the current from the source to the drain (from the emitter and the collector) to turn on an a P-type transistor. Therefore, in the embodiments of the present disclosure, a controlled intermediate terminal of the transistor is referred to as a control electrode, a signal input terminal is referred to as a first electrode, and a signal output terminal is referred to as a second electrode. The transistors used in the embodiments of the present disclosure are mainly switching transistors and drive transistors. In addition, the capacitors used in the embodiments of the present disclosure may be replaced with energy storage elements having similar functions.

In addition, in the description of the present disclosure, "a plurality of" means two or more unless otherwise stated. Herein, the terms "first", "second" and on the like are merely intended to distinguish different parts or steps, rather than be interpreted as specific limitation on the parts or steps.

Figure 1:
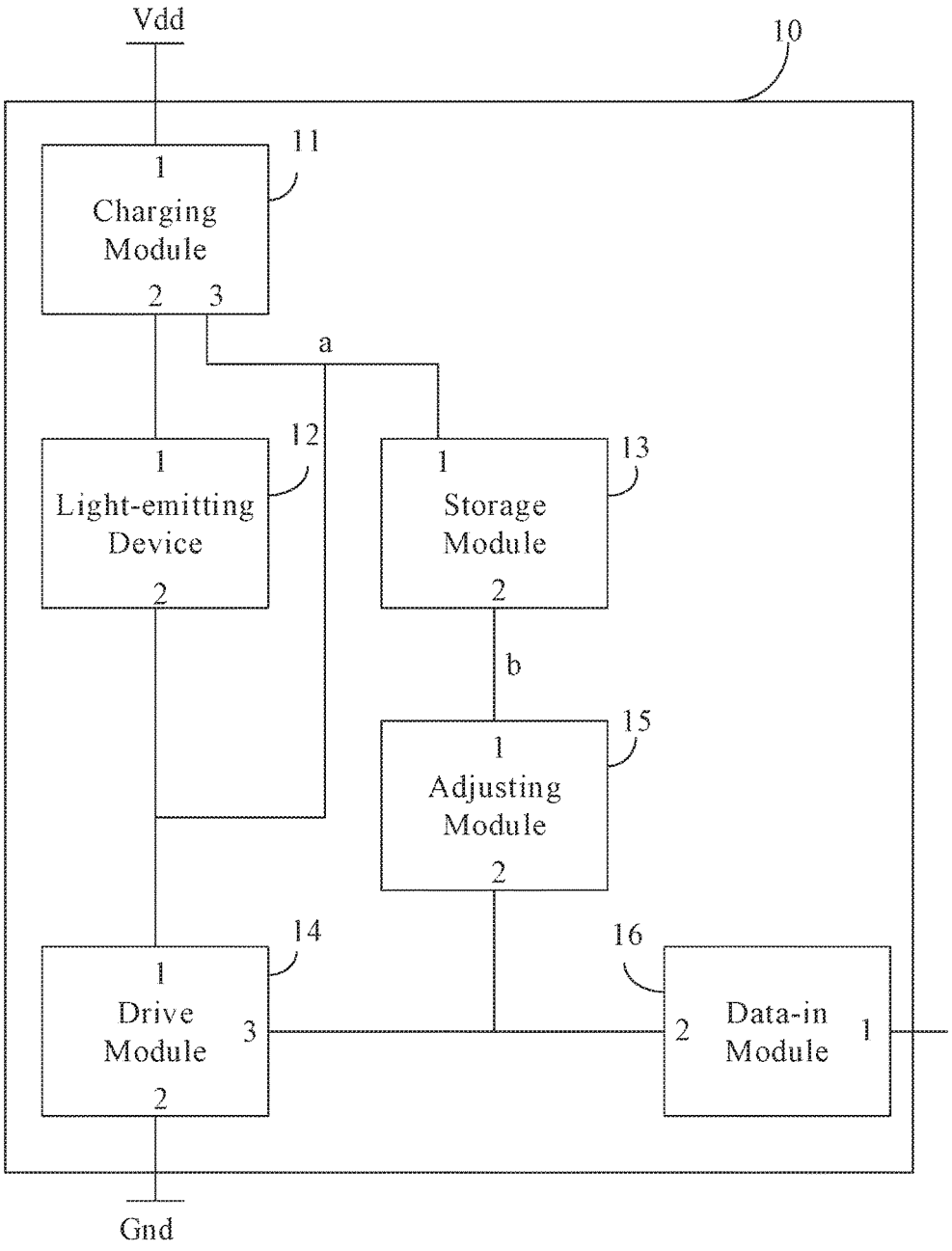
FIG. 1 is a structural block diagram of a pixel circuit according to an embodiment of the present disclosure.

FIG. 1 illustrates a structural block diagram of a pixel circuit according to an embodiment of the present disclosure.

As shown in FIG. 1, a pixel circuit 10 according to the embodiment of the present disclosure includes a charging module 11, a storage module 13, an adjusting module 15, a data-in module 16, a drive module 14, and a light-emitting device 12.

Specifically, a first end of the charging module 11 is configured to receive a first voltage signal (for example, supply voltage Vdd), a second end of the charging module 11 is coupled to a first end of the light-emitting device 12, and a third end of the charging module 11 is coupled to a first end of the storage module 13, a second end of the light-emitting device 12, and a first end of the drive module 14. A second end of the storage module 13 is coupled to a first end of the adjusting module 15. A second end of the adjusting module 15 is coupled to a second end of the data-in module 16 and a third end of the drive module 14. A first end of the data-in module 16 is configured to receive a data signal. A second end of the drive module 14 is configured to receive a second voltage signal, for example, a ground voltage. The charging module 11 is configured to charge the storage module 13. The storage module 13 is configured to store electric charges and can be charged and discharged. The adjusting module 15 is configured to compensate for a voltage of the drive module 14. The drive module 14 is configured to drive the light-emitting device 12 to emit light.

Through the above configuration for compensating the threshold voltage Vth of the drive transistor in the drive module 14, the pixel circuit 10 according to the embodiment of the present disclosure can eliminate current fluctuation caused by drift of the threshold voltage Vth of the drive transistor, thereby maintaining a quality of the display image.

Figure 2:
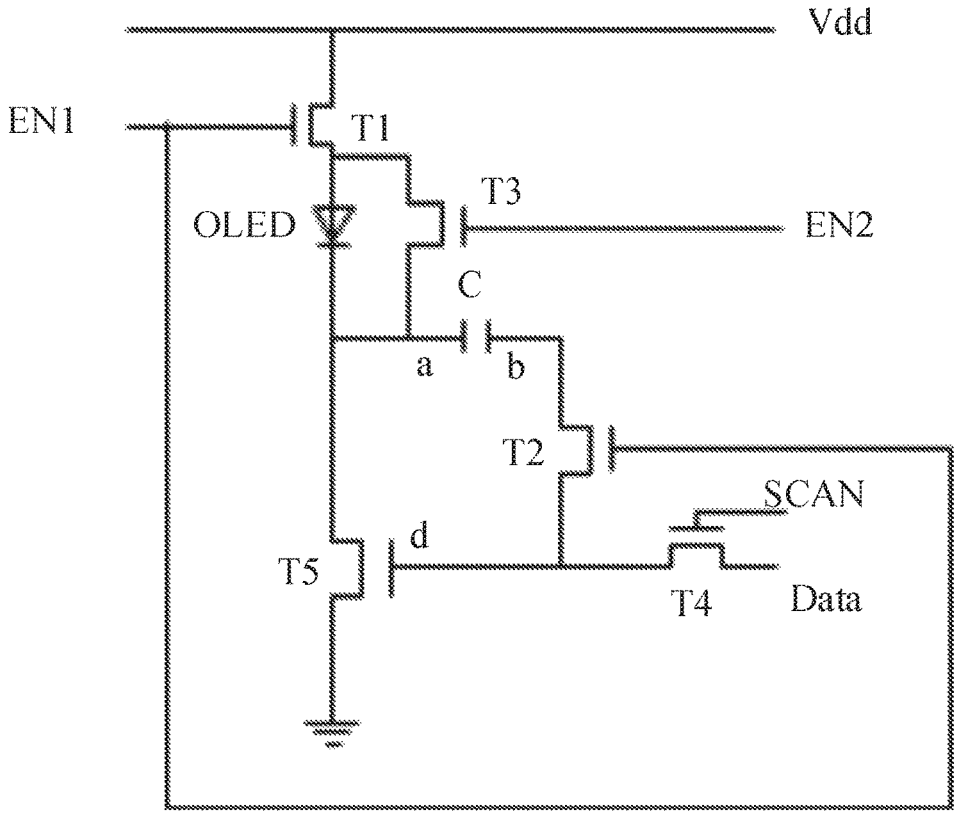
FIG. 2 is a circuit diagram of a pixel circuit according to an embodiment of the present disclosure.

FIG. 2 illustrates a circuit diagram of a pixel circuit according to an embodiment of the present disclosure, which corresponds to the structural block diagram of the pixel circuit in FIG. 1.

In the embodiments of the present disclosure, a description is made by taking N-type transistors as an example. However, according to the teaching provided by the embodiments of the present disclosure, it is conceivable to those skilled in the art that all or some of the N-type transistors in the embodiments may be replaced with P-type transistors. In the embodiments of the present disclosure, a first electrode of an organic light-emitting diode refers to an anode of the organic light-emitting diode, and a second electrode of the organic light-emitting diode refers to a cathode of the organic light-emitting diode.

As shown in FIG. 2, the charging module 11 includes a first transistor T1 and a third transistor T3. The storage module 13 may include a capacitor C. The light-emitting device 12 may be an organic light-emitting diode OLED. The adjusting module 15 may include a second transistor T2. The data-in module 16 may include a fourth transistor T4. And the drive module 14 may include a drive transistor T5.

Specifically, the first end of the charging module 11 is a first electrode of the first transistor T1, a second end of the charging module 11 is a second electrode of the first transistor T1, and a third end of the charging module 11 is a second electrode of the third transistor T3. A control electrode of the first transistor T1 is configured to receive a first control signal EN1. The second electrode of the first transistor T1 is coupled to a first electrode of the third transistor T3 and the first electrode of the organic light-emitting diode OLED. The first electrode of the first transistor T1 is configured to receive a supply voltage Vdd. A control electrode of the third transistor T3 is configured to receive a second control signal EN2. The second electrode of the third transistor T3 is coupled to a first end (i.e., Node a) of the capacitor C, the second electrode of the organic light-emitting diode OLED and a first electrode of the drive transistor T5. The first electrode of the third transistor T3 is coupled to the second electrode of the first transistor T1 and the first electrode of the organic light-emitting diode OLED.

The first end of the adjusting module 15 is the first electrode of the second transistor T2, and the second end of the adjusting module 15 is the second electrode of the second transistor T2. A control electrode of the second transistor T2 is configured to receive a first control signal EN1, the first electrode of the second transistor T2 is coupled to a second end (i.e., Node b) of the capacitor C, and the second electrode of the second transistor T2 is coupled to a second electrode of the fourth transistor T4 and a control electrode of the drive transistor T5.

The first end of the drive module 14 is the first electrode of the drive transistor T5, the second end of the drive module 14 is the second electrode of the drive transistor T5, and the third end of the drive module 14 is the control electrode of the drive transistor T5. The first electrode of the drive transistor T5 is coupled to the first end (i.e., Node a) of the capacitor C, the second electrode of the organic light-emitting diode OLED and the second electrode of the third transistor T3. The second electrode of the drive transistor T5 is grounded, and the control electrode of the drive transistor T5 is coupled to the second electrode of the second transistor T2 and the second electrode of the fourth transistor T4.

The first end of the data-in module 16 is the first electrode of the fourth transistor T4, and the second end of the data-in module 16 is the second electrode of the fourth transistor T4. The control electrode of the fourth transistor T4 is configured to receive a scanning signal SCAN, the first electrode of the fourth transistor T4 is configured to receive a data signal Data, and the second electrode of the fourth transistor T4 is coupled to the control electrode of the drive transistor T5 and the second electrode of the second transistor T2.

As shown in FIG. 2, the pixel circuit 10 according to an embodiment of the present disclosure may include five transistors and one capacitor to solve the display problem caused by drift of the threshold voltage (Vth) of the drive transistor. Compared with a pixel circuit in the prior art that includes more transistors and capacitors, the pixel circuit according to the embodiments of the present disclosure is more concise, and thus can improve the aperture ratio of display panel.

An embodiment of the present disclosure further provides a drive method for driving the above pixel circuit. The drive method may include the following steps. In a charging phase, the storage module 13 is charged. In a voltage adjusting phase, a voltage of the drive module 14 is adjusted. In a light emitting phase, the voltage of the drive module 14 is compensated for and the light-emitting device 12 is kept emitting light.

Figure 3:
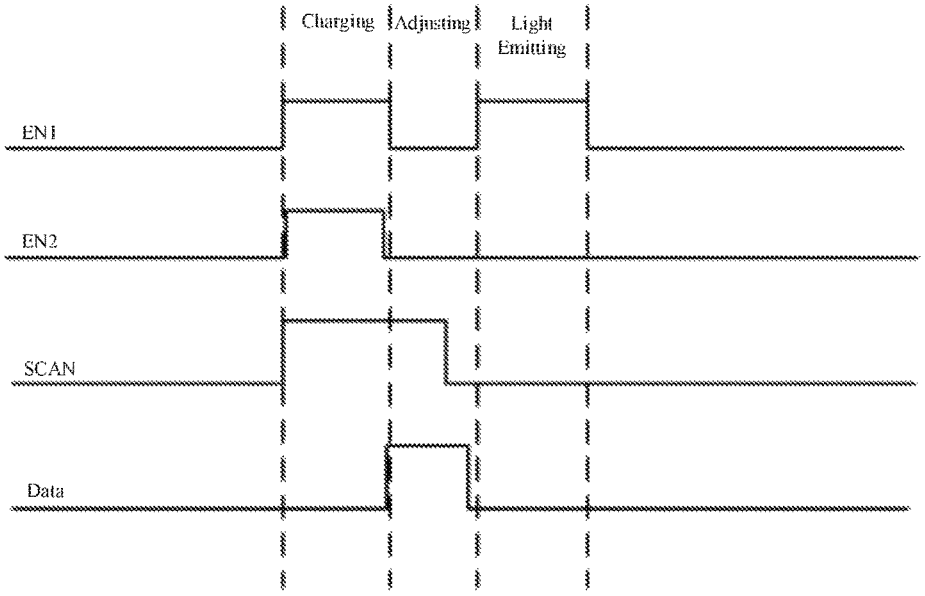
FIG. 3 is a timing chart of a drive signal for driving the pixel circuit as shown in FIG. 2 according to an embodiment of the present disclosure.

FIG. 3 is a timing chart of a drive signal for driving the pixel circuit as shown in FIG. 2 according to an embodiment of the present disclosure.

As shown in FIG. 3, in the charging phase, the first control signal EN1, the second control signal EN2 and the data scanning signal SCAN are at high level, and the data signal Data is at low level. As shown in FIG. 2, the transistors T1, T2, T3, and T4 are turned on, and the transistor T5 is turned off. At this phase, a current path is Vdd-T1-T3-T2-T5-Data, such that the capacitor C is charged, and the voltage at the first end (i.e., the Node a) of the capacitor C is the supply voltage Vdd.

As shown in FIG. 3, in the voltage adjusting phase, the first control signal EN1 and the second control signal EN2 are at low level, and the scanning signal SCAN and the data signal Data are at high level. As shown in FIG. 2, the transistors T1, T2, and T3 are turned off, and the transistors T4 and T5 are turned on. At this phase, the current path is Node a-T4-ground, such that the voltage at the Node a is the sum of the data voltage V and the threshold voltage Vth5 of the drive transistor T5 (i.e., V+Vth5).

As shown in FIG. 2 and FIG. 3, in the light emitting phase, the first control signal EN1 is at high level, and the second control signal EN2, the scanning signal SCAN and the data signal Data are at low level. At this phase, the transistors T3 and T4 are turned off, and the transistors T1, T2 and T5 are turned on. When the transistor T1 is turned on, the voltage Vdd is applied to the Node a, and the second end (i.e., the Node b) of the capacitor C is floating. Because of the capacitor C, the voltage difference among the nodes is maintained. At this phase, the voltage of the gate (i.e., the voltage of Node d) of the transistor T5 is changed to Vd=Vdd−V−Vth5.

According to the following current calculating formula:

$$Id=K(Vgs-Vth5)^2=K((Vdd-Vd)-Vth5)^2=K(Vdd-Vdd+V+Vth5-Vth5)^2=KV^2$$

where K is a constant, which is related to a carrier mobility, a gate oxide layer capacitance and a width-to-length ratio of the drive transistor T5.

Thus, the drive method for driving a pixel circuit according to an embodiment of the present disclosure can eliminate current fluctuation caused by drift of the threshold voltage Vth5 of the drive transistor T5, thereby maintaining the quality of the display image.

It should be noted that relations among the first control signal EN1, the second control signal EN2, the scanning signal SCAN, and the data signal Data in all the phases in FIG. 3 are merely exemplary. According to an embodiment of the present disclosure, the scanning signal SCAN and the data signal Data may be switched to low level before the end of the voltage adjusting phase, separately.

Figure 4:
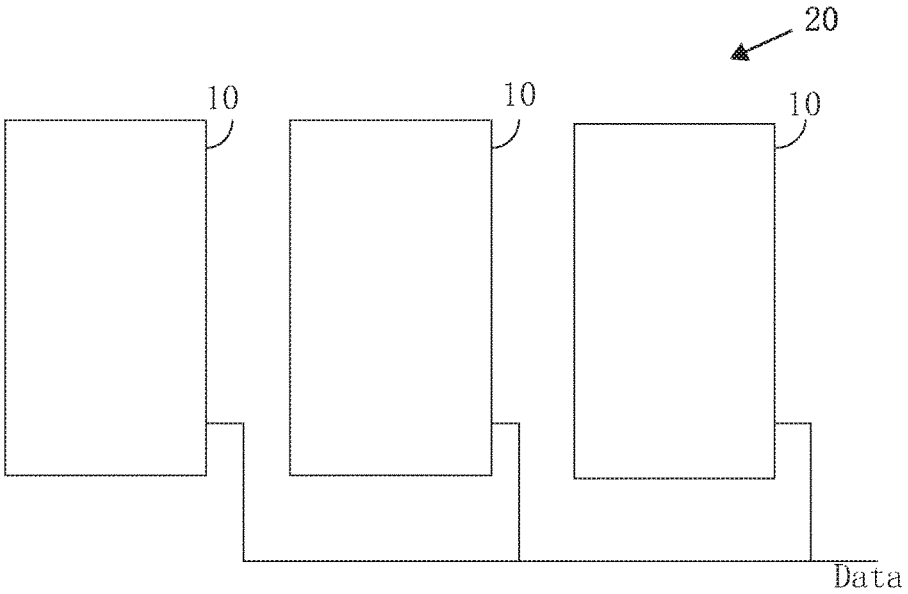
FIG. 4 is a structural block diagram of a pixel circuit group according to an embodiment of the present disclosure.

FIG. 4 illustrates a structural block diagram of a pixel circuit group according to an embodiment of the present disclosure.

As shown in FIG. 4, a pixel circuit group 20 according to an embodiment of the present disclosure may include a plurality of pixel circuits 10. In the pixel circuit group 20, the first ends of the data-in modules 16 of the plurality of pixel circuits 10 are coupled together.

Therefore, the pixel circuit group 20 for data multiplexing according to the embodiment of the present disclosure may control a plurality of subpixels via a data line, such that the number of data lines can be reduced, and thus the number of integrated circuit pins can be saved, thereby reducing the cost of the integrated circuit.

Figure 5:
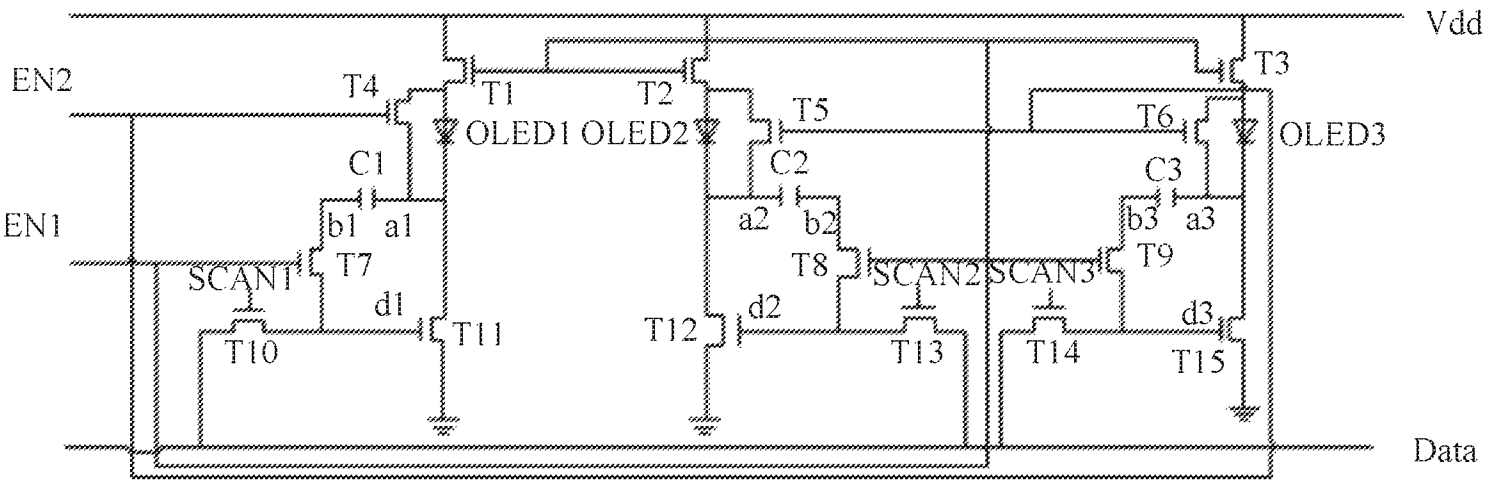
FIG. 5 is a circuit diagram of a pixel circuit group according to an embodiment of the present disclosure.

FIG. 5 illustrates a circuit diagram of a pixel circuit group according to an embodiment of the present disclosure, which corresponds to the structural block diagram of the pixel circuit in FIG. 4.

As can be seen from FIG. 5, the pixel circuit group according to the embodiment of the present disclosure includes three cascaded pixel circuits as shown in FIG. 2. Since the embodiment in FIG. 5 is exemplary and explanatory only, and it is not difficult for those skilled in the art to understand that a pixel circuit group according to another embodiment of the present disclosure may include two cascaded pixel circuits, or more than three cascaded pixel circuits.

Different from FIG. 2, the data-in module of the pixel circuit in FIG. 5 is coupled to the same data line. That is, the first electrodes of the transistors T10, T13, and T14 are coupled together to receive the data signal Data. In addition, the gates of the data-in transistors T10, T13, and T14 are coupled to the scanning signal of the subpixel corresponding to each pixel circuit, respectively.

Therefore, a pixel circuit group according to the embodiment of the present disclosure may control a plurality of subpixels via a data line, such that the number of data lines can be reduced, and thus the number of integrated circuit pins can be saved, thereby reducing the cost of the integrated circuit.

According to the embodiment of the present disclosure, there is further provided a drive method for driving the above pixel circuit group. The drive method may include the following steps. In a charging phase, the storage modules of a plurality of pixel circuits are charged. In a voltage adjusting phase, the voltages of drive modules in the plurality of pixel circuits are adjusted in sequence. In a light emitting phase, the voltages of the drive transistors in the drive modules of the plurality of pixel circuits are compensated for and light-emitting devices are kept emitting light.

Figure 6:
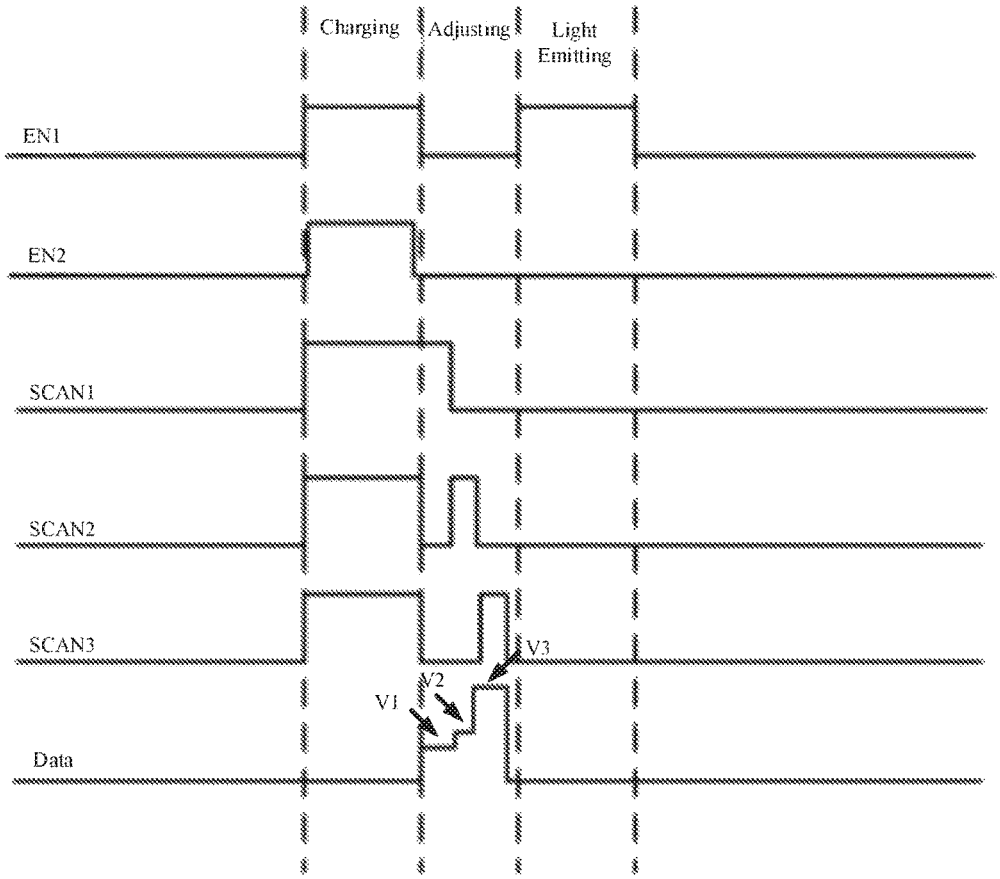
FIG. 6 is a timing chart of a drive signal for driving the pixel circuit group as shown in FIG. 5 according to an embodiment of the present disclosure.

FIG. 6 illustrates a timing chart of a drive signal for driving the pixel circuit group as shown in FIG. 5 according to an embodiment of the present disclosure.

As shown in FIG. 6, in the charging phase, a first control signal EN1, a second control signal EN2, a first scanning signal SCAN1, a second scanning signal SCAN2, and a third scanning signal SCAN3 are at high level, and the data signal Data is at low level. As shown in FIG. 5, the transistors T1-T10, T13 and T14 are turned on, and the transistors T11, T12 and T15 are turned off. At this phase, the current paths in the first pixel circuit to the third pixel circuit are Vdd-T1-T4-T7-T10-Data, Vdd-T2-T5-T8-T13-Data and Vdd-T3-T6-T9-T14-Data respectively, such that the capacitors C1-C3 can be charged respectively, and the voltages between the respective first ends of the capacitors C1-C3 and the respective first electrodes of the transistors T11, T12, and T15 (i.e., the voltages at the Nodes a1-a3) are the supply voltage Vdd.

As shown in FIG. 6, in the voltage adjusting phase, the first control signal EN1 and the second control signal EN2 are at low level, meanwhile the first scanning signal SCAN1, the second scanning signal SCAN2, the third scanning signal SCAN3, and the data signal Data are divided into three subphases.

In the first subphase, the first scanning signal SCAN1 is at high level, and the second scanning signal SCAN2 and the third scanning signal SCAN3 are at low level, meanwhile the data signal Data is at a voltage V1 corresponding to the grayscale of the first subpixel. At this subphase, as shown in FIG. 5, the transistors T1, T4, and T7 are turned off, and the transistors T10 and T11 are turned on. The current path of the first pixel circuit is Node a1-T11-ground, such that the voltage at the Node a1 is the sum of the data voltage V1 and the threshold voltage Vth11 of the drive transistor T11 (i.e., V1+Vth11).

In the second subphase, the second scanning signal SCAN2 is at high level, and the first scanning signal SCAN1 and the third scanning signal SCAN3 are at low level, meanwhile the data signal Data is at a voltage V2 corresponding to the grayscale of the second subpixel. At this subphase, as shown in FIG. 5, the transistors T2, T5, and T8 are turned off, and the transistors T12 and T13 are turned on. The current path of the second pixel circuit is Node a2-T12-ground, such that the voltage of the Node a2 is the sum of the data voltage V2 and the threshold voltage Vth12 of the drive transistor T12 (i.e., V2+Vth12).

In the third subphase, the third scanning signal SCAN3 is at high level, and the first scanning signal SCAN1 and the second scanning signal SCAN2 are at low level, meanwhile the data signal Data is at a voltage V3 corresponding to the grayscale of the third subpixel. At this subphase, as shown in FIG. 5, the transistors T3, T6, and T9 are turned off, and the transistors T14 and T15 are turned on. The current path of the third pixel circuit is Node a3-T15-ground, such that the voltage of the Node a3 is the sum of the data voltage V3 and the threshold voltage Vth15 of the drive transistor T15 (i.e., V3+Vth15).

As shown in FIG. 6, in the light emitting phase, the first control signal EN1 is at high level, and the second control signal EN2, the scanning signals SCAN1-SCAN3 and the data signal Data are at low level.

At this phase, as shown in FIG. 5, in the first pixel circuit, the transistors T4 and T10 are turned off, and the transistors T1, T7, and T11 are turned on. When the transistor T1 is turned on, the voltage Vdd is applied to the Node a1, and the second end (i.e., the Node b1) of the capacitor C1 is floating. Because of the capacitor C, the voltage difference among the nodes is maintained. At this phase, the voltage of the gate (i.e., the voltage of the Node d1) of the drive transistor T11 is changed to Vd1=Vdd−V1−Vth11.

According to the following current calculating formula:

$$Id1=K1(Vgs1-Vth11)^2=K1((Vdd-Vd1)-Vth11)^2=K1(Vdd-Vdd+V1+Vth11-Vth11)^2=K1V1^2$$

where K1 is a constant, which is related to a carrier mobility, a gate oxide layer capacitance and a width-to-length ratio of the drive transistor T11.

Thus, current fluctuation in the first pixel circuit caused by drift of the threshold voltage Vth11 of the drive transistor T11 can be eliminated, thereby maintaining the quality of the display image of the organic light-emitting diode display panel.

At this phase, as shown in FIG. 5, in the second pixel circuit, the transistors T5 and T13 are turned off, and the transistors T2, T8, and T12 are turned on. When the transistor T2 is turned on, the voltage Vdd is applied to the Node a2, and the second end (i.e., the Node b2) of the capacitor C2 is floating. Because of the capacitor C2, the voltage difference among the nodes is maintained. At this phase, the voltage of the gate (i.e., the voltage of Node d2) of the transistor T12 is changed to Vd2=Vdd−V2−Vth12.

According to the following current calculating formula:

$$Id2=K2(Vgs2-Vth12)^2=K2((Vdd-Vd2)-Vth12)^2=K2(Vdd-Vdd+V2+Vth12-Vth12)^2=K2V2^2$$

where K2 is a constant, which is related to a carrier mobility, a gate oxide layer capacitance and a width-to-length ratio of the drive transistor T12.

Thus, current fluctuation in the second pixel circuit caused by drift of the threshold voltage Vth12 can be eliminated, thereby maintaining the quality of the display image of the organic light-emitting diode display panel.

At this phase, as shown in FIG. 5, in the third pixel circuit, the transistors T6 and T14 are turned off, and the transistors T3, T9, and T15 are turned on. When the transistor T3 is turned on, the voltage Vdd is applied to the Node a3, and the second end (i.e., the Node b3) of the capacitor C3 is floating. Because of the capacitor C3, the voltage difference among the nodes is maintained. At this phase, the voltage of the gate (i.e., the voltage of Node d3) of the transistor T15 is changed to Vd3=Vdd−V3−Vth15.

According to the following current calculating formula:

$$Id3=K3(Vgs3-Vth15)^2=K3((Vdd-Vd3)-Vth15)^2=K3(Vdd-Vdd+V3+Vth15-Vth15)^2=K3V3^2$$

where K3 is a constant, which is related to a carrier mobility, a gate oxide layer capacitance and a width-to-length ratio of the drive transistor T15.

Thus, current fluctuation in the third pixel circuit caused by drift of the threshold voltage Vth15 of the drive transistor T15 can be eliminated, thereby maintaining the quality of the display image of the organic light-emitting diode display panel.

It should be noted that relations among the first control signal EN1, the second control signal EN2, the scanning signals SCAN1-SCAN3, and the data signal Data in all the phases in FIG. 6 are merely exemplary. According to the embodiment of the present disclosure, the scanning signals SCAN1-SCAN3 and the data signal Data may be switched to low level before the end of the voltage adjusting phase, separately. Those skilled in the art should understand that voltages V1-V3 of the data signal Data are merely intended for schematically illustrating voltages corresponding to the grayscales of the first subpixel to the third subpixel, but relations among the voltages V1-V3 corresponding to the grayscales of the first subpixel to the third subpixel are not limited thereto.

Based on the same inventive concept, the embodiment of the present disclosure further provides an array substrate including any one of the above pixel circuits or pixel circuit groups, which can eliminate current fluctuation caused by drift of the threshold voltage Vth of the drive transistor, thereby maintaining the quality of the display image.

Based on the same inventive concept, the embodiment of the present disclosure further provides a display panel including any one of the above array substrates, which can eliminate current fluctuation caused by drift of the threshold voltage Vth of the drive transistor, thereby maintaining the quality of the display image.

Based on the same inventive concept, the embodiment of the present disclosure further provides a display device, which includes any one of the above display panels. The display device according to the embodiment of the present disclosure can eliminate current fluctuation caused by drift of the threshold voltage Vth of the drive transistor, thereby maintaining the quality of the display image.

It should be noted that the display device in this embodiment may be any product or component having a display function, such as a display panel, an electronic paper, a mobile phone, a tablet computer, a TV set, a notebook computer, a digital photo frame, a navigation device, and so on.

The abovementioned embodiments are merely the embodiments of the present disclosure, but the scope of protection of the present disclosure is not limited thereto. Any variation or substitution easily conceivable to a person of ordinary skills in the art within the technical scope disclosed in the present disclosure shall fall into the protection scope of the present disclosure. Therefore, the protection scope of the present disclosure shall be subject to the protection scope of the claims.

What is claimed is:

1. A pixel circuit comprising a charging module, a storage module, an adjusting module, a data-in module, a drive module, and a light-emitting device;

wherein a first end of the charging module is configured to receive a first voltage signal, a second end of the charging module is coupled to a first end of the light-emitting device, and a third end of the charging module is coupled to a first end of the storage module, a second end of the light-emitting device, and a first end of the drive module;

wherein a second end of the storage module is coupled to a first end of the adjusting module;

wherein a second end of the adjusting module is coupled to a second end of the data-in module and a third end of the drive module;

wherein a first end of the data-in module is configured to receive a data signal;

wherein a second end of the drive module is configured to receive a second voltage signal; and wherein the charging module is configured to charge the storage module, the adjusting module is configured to compensate for a voltage of the drive module, and the drive module is configured to drive the light-emitting device to emit light.

2. The pixel circuit according to claim 1, wherein the charging module comprises a first transistor and a third transistor;

wherein a first electrode of the first transistor is configured to receive the first voltage signal, a control electrode of the first transistor is configured to receive a first control signal, and a second electrode of the first transistor is coupled to a first electrode of the third transistor and the first end of the light-emitting device; and wherein a control electrode of the third transistor is configured to receive a second control signal, and a second electrode of the third transistor is coupled to the first end of the storage module, the second end of the light-emitting device, and the first end of the drive module.

3. The pixel circuit according to claim 2, wherein the storage module includes a capacitor, wherein a first end of the capacitor is coupled to the first end of the drive module, the second end of the light-emitting device, and the third end of the charging module, and wherein a second end of the capacitor is coupled to the first end of the adjusting module.

4. The pixel circuit according to claim 3, wherein the adjusting module includes a second transistor, wherein a first electrode of the second transistor is coupled to the second end of the capacitor, wherein a second electrode of the second transistor is coupled to the second end of the data-in module and the third end of the drive module, and wherein a control electrode of the second transistor is configured to receive the first control signal.

5. The pixel circuit according to claim 4, wherein the drive module includes a drive transistor, wherein a first electrode of the drive transistor is coupled to the first end of the capacitor, the second end of the light-emitting device, and the third end of the charging module, wherein a second electrode of the drive transistor is configured to receive the second voltage signal, and wherein a control electrode of the drive transistor is coupled to the second electrode of the second transistor and the second end of the data-in module.

6. The pixel circuit according to claim 5, wherein the data-in module includes a fourth transistor, wherein a first electrode of the fourth transistor is configured to receive the data signal, wherein a second electrode of the fourth transistor is coupled to the control electrode of the drive transistor and the second electrode of the second transistor, and wherein a control electrode of the fourth transistor is configured to receive a scanning signal.

7. The pixel circuit according to claim 1, wherein the storage module includes a capacitor, wherein a first end of the capacitor is coupled to the first end of the drive module, the second end of the light-emitting device, and the third end of the charging module, and wherein a second end of the capacitor is coupled to the first end of the adjusting module.

8. The pixel circuit according to claim 7, wherein the adjusting module includes a second transistor, wherein a first electrode of the second transistor is coupled to the second end of the capacitor, wherein a second electrode of the second transistor is coupled to the second end of the data-in module and the third end of the drive module, and wherein a control electrode of the second transistor is configured to receive the first control signal.

9. The pixel circuit according to claim 8, wherein the drive module includes a drive transistor, wherein a first electrode of the drive transistor is coupled to the first end of the capacitor, the second end of the light-emitting device, and the third end of the charging module, wherein a second electrode of the drive transistor is configured to receive the second voltage signal, and wherein a control electrode of the drive transistor is coupled to the second electrode of the second transistor and the second end of the data-in module.

10. The pixel circuit according to claim 9, wherein the data-in module includes a fourth transistor, wherein a first electrode of the fourth transistor is configured to receive the data signal, wherein a second electrode of the fourth transistor is coupled to the control electrode of the drive transistor and the second electrode of the second transistor, and wherein a control electrode of the fourth transistor is configured to receive a scanning signal.

11. The pixel circuit according to claim 10, wherein the transistors in the pixel circuit are N-type transistors.

12. The pixel circuit according to claim 10, wherein the transistors in the pixel circuit are P-type transistors.

13. A pixel circuit group comprising a plurality of pixel circuits according to claim 1, wherein the data-in modules of the plurality of pixel circuits are coupled to the same data line.

14. A drive method for driving the pixel circuit group according to claim 13, the drive method comprising:

in a charging phase, charging the storage modules of the plurality of pixel circuits such that a voltage at the first end of the storage module of each pixel circuit is a first voltage, in a voltage adjusting phase, adjusting the voltage of the drive modules of the plurality of pixel circuits in sequence such that the voltage at the first end of the storage module of each pixel circuit is a sum of the data voltage of the corresponding pixel circuit and a threshold voltage of the drive transistor in the drive module of the corresponding pixel circuit; and in a light emitting phase, keeping the light-emitting device emitting light and causing a voltage at the third end of the drive module of each pixel circuit to equal the first voltage minus the sum of the data voltage of the corresponding pixel circuit and the threshold voltage of the drive transistor in the drive module of the corresponding pixel circuit.

15. An array substrate comprising the pixel circuit group according to claim 13.

16. A display panel comprising the array substrate according to claim 15.

17. A drive method for driving the pixel circuit according to claim 1, the drive method comprising:

in a charging phase, charging the storage module such that a voltage at the first end of the storage module is a first voltage;

in a voltage adjusting phase, adjusting the voltage of the drive module such that the voltage at the first end of the storage module is a sum of the data voltage and a threshold voltage of the drive transistor in the drive module; and in a light emitting phase, keeping the light-emitting device emitting light and causing a voltage at the third end of the drive module to equal the first voltage minus the sum of the data voltage and the threshold voltage of the drive transistor in the drive module.

18. An array substrate comprising the pixel circuit according to claim 1.

19. A display panel comprising the array substrate according to claim 18.

20. A display device comprising the display panel according to claim 19.

* * * * *